US006503681B2

(12) United States Patent
Makino et al.

(10) Patent No.: US 6,503,681 B2
(45) Date of Patent: Jan. 7, 2003

(54) PROCESS FOR THE PRODUCTION OF TONER FOR DEVELOPING ELECTROSTATIC IMAGE

(75) Inventors: Nobuyasu Makino, Numazu (JP); Tomotsugu Miyamoto, Mishima (JP); Mitsuyoshi Izu, Numazu (JP); Ryoichi Ito, Numazu (JP); Yasuaki Iwamoto, Numazu (JP); Kazuyuki Yazaki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 47 days.

(21) Appl. No.: 09/740,865

(22) Filed: Dec. 21, 2000

(65) Prior Publication Data

US 2001/0006197 A1 Jul. 5, 2001

(30) Foreign Application Priority Data

Dec. 21, 1999 (JP) ..... 11-362626

(51) Int. Cl.[7] ..... G03G 9/00
(52) U.S. Cl. ..... 430/137.2; 430/110.4
(58) Field of Search ..... 430/110.4, 137.18, 430/137.2

(56) References Cited

U.S. PATENT DOCUMENTS 4,784,333 A * 11/1988 Hikake et al. ..... 430/137.21
5,712,071 A * 1/1998 Mikuriya et al. ..... 430/111.4
5,975,446 A * 11/1999 Yaguchi et al. ..... 241/76

OTHER PUBLICATIONS

U.S. patent application Ser. No. 09/765,392, filed Jan. 22, 2001, pending.

U.S. patent application Ser. No. 09/740,865, filed Dec. 21, 2000, pending.

* cited by examiner

*Primary Examiner*—John Goodrow
(74) *Attorney, Agent, or Firm*—Oblon, Spivak, McClelland, Maier & Neustadt, P.C.

(57) ABSTRACT

A two-step process for the production of a toner for developing electrostatic images, including a first pulverizing step wherein a toner composition containing a binder and a coloring agent is pulverized to obtain preliminarily pulverized particles having a weight average particle diameter of 20–100 $\mu$m and containing no more than 50% by weight of particles having roundness of 0.90 or less, and a second pulverizing step wherein the preliminarily pulverized particles are finely pulverized to obtain finely pulverized particles having a weight average particle diameter of 5–13 $\mu$m and containing no more than 30% by weight of particles having roundness of 0.90 or less and no more than 15%, based on the total number of particles of the finely pulverized particles, of particles having a particle diameter of 5 $\mu$m or less.

18 Claims, No Drawings

PROCESS FOR THE PRODUCTION OF TONER FOR DEVELOPING ELECTROSTATIC IMAGE

BACKGROUND OF THE INVENTION

This invention relates to a toner for developing electrostatic images using an electrophotographic image forming device such as a copying machine, a printer or a facsimile machine.

In a dry copying method, an electrostatic latent image on a photosensitive medium is developed with a toner composed of a binder and a coloring agent. The developed toner image is transferred to a transfer member such as paper and fixed there.

With recent development of digital copying machines and laser printers, there is an increasing demand for a developer capable of giving high quality images. While the current level for high quality images is 300 dpi, it is well expected that higher quality as high as 480 psi or, further, 600 psi, will be required in the near future.

In this circumstance, production of fine particle toner will be of very importance for obtaining high quality images. With a decrease of the particle size of toner, however, agglomeration and deposition of toner particles are apt to occur. As a consequence, there are caused a number of problems such as failure of supplying toner from a toner storage section to an image developing section and failure of transferring toner from the image development section to the electrostatic image bearing surface.

Toner is generally produced by first blending raw material ingredients thereof such as a binder and a coloring agent. The mixture is then kneaded with a kneader such as an extruder at a temperature higher than the melting point of the binder. The kneaded mixture is extruded into a plate, solidified and then pulverized. The pulverization generally includes a series of coarse pulverization, medium pulverization and fine pulverization.

One known pulverization method includes a first step in which a solidified toner composition is coarsely pulverized with a hammer crusher, a second step in which the coarsely pulverized product is pulverized into a medium size with an impact-type pulverizer, and a third step in which the product in the second step is finely pulverized with a jet mill using an air jet method.

The product obtained with the known method has a small average particle diameter. However, because of a large content (15–50% based on the total number of particles) of excessively fine particles, the toner causes a problem of background stains in the produced images. Thus, in order to remove such excessively fine particles, it is necessary to conduct an additional treatment so that the production efficiency is lowered. The conventional method has an additional disadvantage because the third step consumes great energy and requires high production costs.

SUMMARY OF THE INVENTION

It is an object of the present invention to provide a process which can produce toner capable of forming high quality toner images.

Another object of the present invention is to provide an economically acceptable process which can produce, with reduced energy for pulverization, toner having suitable particle size characteristics and a suitable particle shape.

It is a further object of the present invention to provide a process of the above-mentioned type which can produce toner having a reduced content of excessively fine particles.

In accordance with the present invention, there is provided a process for the production of a toner for developing electrostatic images, comprising:

a first pulverizing step wherein a toner composition comprising a binder and a coloring agent is pulverized with a first pulverizer to obtain preliminarily pulverized particles having a weight average particle diameter of 20–100 μm and containing no more than 50% by weight of particles having roundness of 0.90 or less; and a second pulverizing step wherein the preliminarily pulverized particles are finely pulverized with a second pulverizer to obtain finely pulverized particles having a weight average particle diameter of 5–13 μm and containing no more than 30% by weight of particles having roundness of 0.90 or less and no more than 15%, based on the total number of particles of the finely pulverized particles, of particles having a particle diameter of 5 μm or less.

In the present specification and appended claims, the terms "WEIGHT AVERAGE PARTICLE DIAMETER", "ROUNDNESS", "ACTUAL LOAD POWER FOR PULVERIZATION" and "PULVERIZATION BY IMPACT AND SHEARING FORCES" are intended to refer as follows.

WEIGHT AVERAGE PARTICLE DIAMETER:

The particle diameter distribution of the toner is measured with a Coulter Multisizer II (manufactured by Coulter Electronics, Inc.). As an electrolytic solution for measurement, an aqueous 1% by weight NaCl solution of first-grade sodium chloride is used. A dispersant (0.5–5 ml of a salt of alkylbenzenesulfonic acid) is added to 10 to 15 ml of the above electrolytic solution, to which 2 to 20 mg of a sample to be measured are added. The resulting mixture is subjected to a dispersing treatment for about 1–3 minute to about 3 minutes in an ultrasonic dispersing machine. The electrolytic solution (100–200 ml) is taken in another vessel, to which a predetermined amount of the dispersed sample is added. Using an aperture of 100 μm in the above particle size distribution measuring device, the particle size distribution is measured on the basis of the particle number with the Coulter counter for particles having a diameter in the range of 2–40 μm. The number and weight particle distribution are calculated. The weight average diameter of the toner is determined from that weight distribution. The median value of each channel is used as the representative of that channel.

ROUNDNESS:

Roundness of toner is defined by the following formula:

$$\text{Roundness} = \sqrt{4\pi A / B^2}$$

wherein A represents an area of a projected image of a toner particle and B represents a peripheral length of the projected image. Roundness is measured with a flow-type particle image analyzer FPIA-1000 (manufactured by Toa Medical Electronics Co., Ltd.). The roundness becomes nearer to 1 as the contour of the particle becomes smoother and the particle becomes more spherical. Average roundness is an average of the measured values for 7000 to 13000 toner particles.

ACTUAL LOAD POWER FOR PULVERIZATION:

Actual load power is defined by the following formula:

$$\text{Actual load power} = P_f - P_0$$

wherein $P_f$ represents load power (kW·h/kg) required for pulverizing a raw material feed and $P_0$ represents load power required for operation with no raw material feed.

Other objects, features and advantages of the present invention will become apparent from the detailed description of the preferred embodiments of the invention to follow.

DETAILED DESCRIPTION OF THE PREFERRED EMBODIMENTS OF THE INVENTION

For the production of a toner according to the present invention, a composition containing a binder and a coloring agent is first provided. Any conventional binder may be used for the purpose of the present invention. Examples of the binder include a polyester resin; a hydrogenated petroleum resin; a styrene resin such as polystyrene, poly(p-chlorostyrene), poly(vinyltoluene), a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl a-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene terpolymer, a styrene-maleic acid copolymer or a styrene-maleate copolymer; poly (methyl methacrylate); poly(butyl methacrylate); poly(vinyl chloride); poly(vinyl acetate); polyethylene; polypropylene, polyester; polyurethane; polyamide; an epoxy resin; poly (vinyl butyral); poly(vinyl acetal); poly(acrylic acid); rosin; modified rosin; a terpene resin; an aliphatic or alicyclic hydrocarbon resin; chlorinated paraffin; or paraffin wax. These resins may be used by themselves or as a mixture of two or more.

Any known colorant may be used for the purpose of the invention. The colorant may be a black colorant such as carbon black, aniline black, furnace black, lamp black or iron black; a cyan colorant such as phthalocyanine blue, methylene blue, Victoria blue, methyl violet, ultramarine blue or aniline blue; a magenta colorant such as rhodamine 6G lake, dimethylquinacridone, watching red, rose bengal, rhodamine B or alizarin lake; or a yellow pigment such as chrome yellow, benzidine yellow, Hansa yellow G, naphthol yellow, quinoline yellow, azomethylene yellow or tartrazine. These colorants may be used by themselves or in combination with two or more.

The amount of the coloring agent is not specifically limited but is generally in the range of 5–30 parts by weight, preferably 10–20 parts by weight, per 100 parts by weight of the binder.

The toner composition may contain a customarily employed charge controlling agent. Illustrative of suitable positively charging agents are nigrosine, basic dyes, lake pigments of basic dyes and quaternary ammonium salts. Illustrative of suitable negatively charging agents are metal salts of monoazo dyes, salicylic acid, naphthoic acid and metal complexes of dicarboxylic acids.

The toner composition may also contain one or more additives, if desired. Illustrative of additives are a lubricant such as tetrafluoroethylene or zinc stearate; an abrasive such as cerium oxide or silicon carbide; a flowability improving agent (caking-prevention agent) such as colloidal silica or aluminum oxide; an electrical conductivity-imparting agent such as carbon black or tin oxide; a fixation adjuvant such as a low molecular weight polyolefin; and a mold release agent such as solid silicone vanish, higher aliphatic alcohol, a low molecular weight polypropylene, a low molecular weight polyethylene, carnauba wax, microcrystalline wax, rice wax, hohoba wax or montaic acid wax.

The amount of the ingredients other than the binder and the coloring agent is such that the total weight of the coloring agent and the binder is generally 20% by weight or less, preferably 0.5–15% by weight, more preferably 0.5–5% by weight, based on the total weight of the toner composition.

The above composition containing a-binder and a coloring agent is kneaded using a roll mill or a kneader at a temperature higher than the melting point of the binder. The kneaded composition is then cooled and subjected to a first pulverizing step wherein the composition is pulverized to obtain preliminarily pulverized particles. If desired, the kneaded composition may be molded by, for example, extrusion, into any suitable form, such as a plate, and may be coarsely pulverized, with, for example, a hammer crusher or a feather mill, into coarse particles having a diameter of, for example, 0.3–20 mm.

The first pulverizing step may be carried out using a first pulverizer, for example, ACM Pulverizer (manufactured by Hosokawa Micron Corporation), Fine Mill (manufactured by Nippon Pneumatic Industry Co., Ltd.), or Hybridizer (manufactured by Nara Machinery Co., Ltd).

The typical example of the first pulverizer has an axially extending cylindrical rotor disposed generally coaxially within a cylindrical stator with a gap of at least 1.5 mm being defined therebetween. The exterior surface of the rotor and the interior surface of the stator are each provided with a multiplicity of parallel ridges interspersed with alternately interposed troughs. The ridges and troughs extend in the direction of the generatrices of the rotor and the stator. By rotation of the rotor, a feed material introduced into the gap is comminuted. The pulverizer is preferably operated so that the peripheral speed of the rotor is less than 100 m/s. A collision-type pulverizer equipped with a classifier may be suitably used.

The first pulverization step is preferably performed with an actual total load power (total power required for the pulverization) of 0.25–210 kW·h, more preferably 0.5–140 kW·h, when the feed rate of the toner composition is 50–300 kg/hr.

It is important that the first step should be performed so that the preliminarily pulverized particles obtained have a weight average particle diameter of 20–100 $\mu$m, preferably 20–70 $\mu$m, and contain no more than 50% by weight, preferably no more than 30% by weight, of particles having roundness of 0.90 or less.

When the preliminarily pulverized particles obtained have a weight average particle diameter of less than 20 $\mu$m, fusion of the particles is caused. Too large a weight average particle diameter in excess of 100 $\mu$m causes a reduction of roundness of the particles so that excessively fine particles will be produced in the succeeding second pulverization step. When the content of particles having roundness of 0.90 or less exceeds 50% by weight, excessively fine particles will be produced in the succeeding second pulverization step. It is preferred that the first step be performed so that average roundness of the preliminarily pulverized particles is 0.85 or more for reasons of preventing the formation of excessively fine particles in the succeeding second pulverization step.

The preliminarily pulverized particles obtained in the first pulverization step is then subjected to a second pulverizing step wherein the preliminarily pulverized particles are finely pulverized with a second pulverizer to obtain finely pulverized particles.

The second pulverizer may be an impact and shear-type pulverizer such as Turbo Mill (manufactured by Turbo Industrial Company Ltd.), Super Rotor (manufactured by Nissin Engineering Co., Ltd.), Model Krypton (manufactured by Kawasaki Heavy Industries Co., Ltd.) or Inomizer (manufactured by Hosokawa Micron Co., Ltd.).

The typical example of the impact and shear-type pulverizer has an axially extending cylindrical rotor disposed generally coaxially within a cylindrical stator with a gap of less than 1.5 mm being defined therebetween.

The exterior surface of the rotor and the interior surface of the stator are each provided with a multiplicity of parallel ridges interspersed with alternately interposed troughs. The ridges and troughs extend in the direction of the generatrices of the rotor and the stator. By rotation of the rotor, a feed material introduced into the gap is comminuted. The pulverizer is preferably operated so that the peripheral speed of the rotor is not lower than 100 m/s. An impact and shear-type pulverizer equipped with a classifier may be suitably used.

It is important that the second pulverization step should be carried out so that the finely pulverized particles produced have a weight average particle diameter of 5–13 μm, preferably 6–10 μm, and contain no more than 30% by weight, preferably no more than 20% by weight, of particles having roundness of 0.90 or less and no more than 15%, preferably no more than 10%, based on the total number of particles of the finely pulverized particles, of particles having a particle diameter of 5 μm or less.

When the second pulverization step is carried out so that the finely pulverized particles obtained have a weight average particle diameter of 5 μm or less, the energy consumption in the second pulverization step is excessively high. Too large a weight average particle diameter in excess of 13 μm is undesirable because satisfactory roundness of the toner particles is not obtainable. When the content of particles having roundness of 0.90 or less is greater than 30% by weight, the energy consumption in the second pulverization step is excessively high. When the content of particles having a particle diameter of 5 μm or less is 15% or more based on the total number of particles of the finely pulverized particles, agglomeration of toner will be caused. It is preferred that the second pulverization step is carried out so that the finely pulverized particles obtained have an average roundness of 0.90–0.98.

The second pulverization step is preferably performed with an actual load power (power required for pulverizing 1 kg of the feed per unit time) of 0.05–0.9 kW·h/kg, more preferably 0.1–0.8 kW·h/kg. Since the preliminarily pulverized particles have suitable roundness and particle size distribution, the second step can be carried out with a reduced power consumption.

It is also preferred that the second pulverization step be performed so that the ratio of the actual load power of the pulverization in the first step to that in the second step be in the range of 1:10 to 1:2, more preferably 1:5 to 2:5, for reasons of preventing the formation of excessively pulverized particles and of reducing the energy consumption It is preferred that the preliminarily pulverized particles are fed to the second step at a feed rate of W kg/h, while feeding air (or any other suitable gas) at a flow rate of M $m^3$/minute to the second step, and that the ratio W/M be in the range of 1–200. The preliminary pulverized particles may be carried and fed to the second step by the flowing air fed thereto.

The following examples will further illustrate the present invention. Percentages are by weight unless otherwise noted.

EXAMPLE 1

A composition containing 75% of a polyester resin, 10% of a styrene-acrylate copolymer and 15% of carbon black were throughly mixed and then kneaded using a roll mill at 120° C. The kneaded composition was cooled and coarsely crushed to obtain a raw material composition.

The raw material composition was subjected to a first pulverization step using ACM Pulverizer (manufactured by Hosokawa Micron Corporation) with a rotor peripheral speed of 70 m/s and at an outlet temperature of 30° C. to obtain preliminarily pulverized particles having a weight average particle diameter of 50 μm and an average roundness of 0.93 and containing particles having a roundness of 0.90 or less in an amount of 30%. The first pulverization step required an actual load power of 0.21 kw·h/kg.

The preliminarily pulverized particles were then subjected to a second pulverization step using Turbo Mill (manufactured by Turbo Industrial Company Ltd.) with a rotor peripheral speed of 110 m/s and a gap between the rotor and interior operating surface of the stator of 1.0 mm and at an outlet temperature of 35° C., thereby to obtain finely pulverized particles having a weight average particle diameter of 9.5 μm and an average roundness of 0.96 and containing (a) particles having a roundness of 0.90 or less in an amount of 15% and (b) particles having a particle diameter of 5 μm or less in an amount of 10% based on the total number of particles of the finely pulverized particles. The yield of the finely pulverized particles was 90%. The second pulverization step required an actual load power of 0.7 kw·h/kg. The ratio of the actual load power of the pulverization in said first step to that in the second step was thus 3:10. A classifier (Elbow Jet manufactured by Nittetu Kogyo Co., Ltd.) was used for adjusting the particle size in the second step.

COMPARATIVE EXAMPLE

The raw material composition obtained in Example 1 was subjected to a first pulverization step using ACM Pulverizer (manufactured by Hosokawa Micron Corporation) with a rotor peripheral speed of 70 m/s and at an outlet temperature of 30° C. to obtain preliminarily pulverized particles having a weight average particle diameter of 50 μm and an average roundness of 0.80 and containing particles having a roundness of 0.90 or less in an amount of 55%. The first pulverization step required an actual load power of 0.04 kw·h/kg.

The preliminarily pulverized particles were then subjected to a second pulverization step using Type 1 Mill (manufactured by Nippon Pneumatic Industry Co., Ltd.) in conjunction with a classifier (DS Classifier manufactured by Nippon Pneumatic Industry Co., Ltd.) connected to the pulverizer to form a closed circuit, thereby to obtain finely pulverized particles having a weight average particle diameter of 9.5 μm and an average roundness of 0.95 and containing (a) particles having a roundness of 0.90 or less in an amount of 10% and (b) particles having a particle diameter of 5 μm or less in an amount of 10% based on the total number of particles of the finely pulverized particles. The yield of the finely pulverized particles was 80%. The second pulverization step required an actual load power of 0.8 kw·h/kg. The ratio of the actual load power of the pulverization in said first step to that in the second step was thus 1:20. Excessively small particles were found to produced in a large amount.

EXAMPLE 2

The raw material composition obtained in Example 1 was subjected to a first pulverization step using ACM Pulverizer (manufactured by Hosokawa Micron Corporation) with a rotor peripheral speed of 70 m/s and at an outlet temperature of 30° C. to obtain preliminarily pulverized particles having a weight average particle diameter of 50 μm and an average roundness of 0.93 and containing particles having a roundness of 0.90 or less in an amount of 30%. The first pulverization step required an actual load power of 0.23 kw·h/kg.

The preliminarily obtained particles were then subjected to a second pulverization step using Turbo Mill (manufactured by Turbo Industrial Company Ltd.) with a rotor peripheral speed of 110 m/s and a gap between the rotor and interior operating surface of the stator of 1.0 mm, while feeding the preliminarily pulverized particles to the second pulverization step at a feed rate of W kg/h using air flowing at flow rate of M $m^3$/minute, so that the ratio W/M was 120, thereby to obtain finely pulverized particles having a weight average particle diameter of 9.5 μm and an average roundness of 0.963 and containing (a) particles having a roundness of 0.90 or less in an amount of 10% and (b) particles having a particle diameter of 5 μm or less in an amount of 10% based on the total number of particles of the finely pulverized particles. The yield of the finely pulverized particles was 93%. The second pulverization step required an actual load power of 0.7 kw·h/kg. The ratio of the actual load power of the pulverization in said first step to that in the second step was thus 3.3:10. A classifier (Elbow Jet manufactured by Nittetu Kogyo Co., Ltd.) was used in the second step for adjusting the particle size.

EXAMPLE 3

The raw material composition obtained in Example 1 was subjected to a first pulverization step using ACM Pulverizer (manufactured by Hosokawa Micron Corporation) with a rotor peripheral speed of 75 m/s and at an outlet temperature of 35° C. to obtain preliminarily pulverized particles having a weight average particle diameter of 40 μm and an average roundness of 0.94 and containing particles having a roundness of 0.90 or less in an amount of 35%. The first pulverization step required an actual load power of 0.25 kw·h/kg.

The preliminarily pulverized particles were then subjected to a second pulverization step using Turbo Mill (manufactured by Turbo Industrial Company Ltd.) with a rotor peripheral speed of 120 m/s and a gap between the rotor and interior operating surface of the stator of 1.2 mm and at an outlet temperature which was higher by 30° C. than the inlet temperature, thereby to obtain finely pulverized particles having a weight average particle diameter of 9.5 μm and an average roundness of 0.98 and containing (a) particles having a roundness of 0.90 or less in an amount of 20% and (b) particles having a particle diameter of 5 μm or less in an amount of 10% based on the total number of particles of the finely pulverized particles. The yield of the finely pulverized particles was 93%. The second pulverization step required an actual load power of 0.7 kw·h/kg. The ratio of the actual load power of the pulverization in said first step to that in the second step was thus 3.6:10. A classifier (Elbow Jet manufactured by Nittetu Kogyo Co., Ltd.) was used for adjusting the particle size in the second step.

EXAMPLE 4

The raw material composition obtained in Example 1 was subjected to a first pulverization step using ACM Pulverizer (manufactured by Hosokawa Micron Corporation) with a rotor peripheral speed of 75 m/s and at an outlet temperature of 25° C. to obtain preliminarily pulverized particles having a weight average particle diameter of 38 μm and an average roundness of 0.94 and containing particles having a roundness of 0.90 or less in an amount of 30%. The first pulverization step required an actual load power of 0.15 kw·h/kg.

The preliminarily pulverized particles were then subjected to a second pulverization step using Turbo Mill (manufactured by Turbo Industrial Company Ltd.) with a rotor peripheral speed of 115 m/s and a gap between the rotor and interior operating surface of the stator of 1.1 mm and at an outlet temperature which was higher by 35° C. than the inlet temperature, thereby to obtain finely pulverized particles having a weight average particle diameter of 9.5 μm and an average roundness of 0.98 and containing (a) particles having a roundness of 0.90 or less in an amount of 20% and (b) particles having a particle diameter of 5 μm or less in an amount of 10% based on the total number of particles of the finely pulverized particles. The yield of the finely pulverized particles was 94%. The second pulverization step required an actual load power of 0.40 kw·h/kg. The ratio of the actual load power of the pulverization in said first step to that in the second step was thus 3.8:10. A classifier (Elbow Jet manufactured by Nittetu Kogyo Co., Ltd.) was used for adjusting the particle size in the second step.

EXAMPLE 5

The raw material composition obtained in Example 1 was subjected to a first pulverization step using ACM Pulverizer (manufactured by Hosokawa Micron Corporation) with a rotor peripheral speed of 75 m/s and at an outlet temperature of 25° C. to obtain preliminarily pulverized particles having a weight average particle diameter of 38 μm and an average roundness of 0.98 and containing particles having a roundness of 0.90 or less in an amount of 25%. The first pulverization step required an actual load power of 0.21 kw·h/kg.

The preliminarily pulverized particles were then subjected to a second pulverization step using Turbo Mill (manufactured by Turbo Industrial Company Ltd.) with a rotor peripheral speed of 115 m/s and a gap between the rotor and interior operating surface of the stator of 1.1 mm and at an outlet temperature which was higher by 35° C. than the inlet temperature, thereby to obtain finely pulverized particles having a weight average particle diameter of 9.5 μm and an average roundness of 0.98 and containing (a) particles having a roundness of 0.90 or less in an amount of 25% and (b) particles having a particle diameter of 5 μm or less in an amount of 10% based on the total number of particles of the finely pulverized particles. The yield of the finely pulverized particles was 94%. The second pulverization step required an actual load power of 0.7 kw·h/kg. The ratio of the actual load power of the pulverization in said first step to that in the second step was thus 3:10. A classifier (Elbow Jet manufactured by Nittetu Kogyo Co., Ltd.) was used for adjusting the particle size in the second step.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A process for the production of a toner for developing electrostatic images, comprising:

a first pulverizing step wherein a toner composition comprising a binder and a coloring agent is pulverized with a first pulverizer to obtain preliminarily pulverized particles having a weight average particle diameter of 20–100 μm and containing no more than 50% by weight of particles having a roundness of 0.90 or less; and a second pulverizing step wherein the preliminarily pulverized particles are finely pulverized with a second pulverizer to obtain finely pulverized particles having a weight average particle diameter of 5–13 μm and containing no more than 30% by weight of particles having a roundness of 0.90 or less and no more than 15%, based on the total number of particles of the finely pulverized particles, of particles having a particle diameter of 5 μm or less.

2. A process as claimed in claim 1, wherein the preliminarily pulverized particles are finely pulverized with an actual load power for pulverization of 0.05–0.90 kw·h/kg.

3. A process as claimed in claim 1, wherein the ratio of the actual load power of the pulverization in said first step to that in the second step is 1:10 to 1:2.

4. A process as claimed in claim 1, wherein said first pulverizer has an axially extending cylindrical rotor disposed generally coaxially within a cylindrical stator with a gap of at least 1.5 mm being defined therebetween for the pulverization of the toner composition.

5. A process as claimed in claim 4, wherein said rotor is operated at a peripheral speed of less than 100 m/s.

6. A process as claimed in claim 1, wherein said second pulverizer has an axially extending cylindrical rotor disposed generally coaxially within a cylindrical stator with a gap of less than 1.5 mm being defined therebetween for the pulverization of the toner composition.

7. A process as claimed in claim 6, wherein said rotor is operated at a peripheral speed of at least 100 m/s.

8. A process as claimed in claim 1, wherein the preliminarily pulverized particles are fed to said second step at a feed rate of W kg/h while feeding a gas to said second step at a flow rate of M $m^3$/minute, and wherein the ratio W/M is in the range of 1–200.

9. A process as claimed in claim 1, wherein the preliminarily pulverized particles have an average roundness of 0.85–0.95 and wherein the finely pulverized particles have an average roundness greater than that of the preliminarily pulverized particles and in the range of 0.90–0.98.

10. A process for the production of a toner for developing electrostatic images, comprising:

a first pulverizing step wherein a toner composition comprising a binder and a coloring agent is pulverized with a first pulverizer to obtain preliminarily pulverized particles having a weight average particle diameter of 20–100 μm and containing no more than 50% by weight of particles having a roundness of 0.90 or less; and a second pulverizing step wherein the preliminarily pulverized particles are finely pulverized with a second pulverizer to obtain finely pulverized particles having a weight average particle diameter of 5–13 μm and containing no more than 30% by weight of particles having a roundness of 0.90 or less and no more than 15%, based on the total number of particles of the finely pulverized particles, of particles having a particle diameter of 5 μm or less;

wherein the actual load power of the second pulverizing step is higher than the actual load power of the first pulverizing step.

11. A process as claimed in claim 10, wherein the preliminarily pulverized particles are finely pulverized with an actual load power for pulverization of 0.05–0.90 kw·h/kg.

12. A process as claimed in claim 10, wherein the ratio of the actual load power of the pulverization in said first step to that in the second step is 1:10 to 1:2.

13. A process as claimed in claim 10, wherein said first pulverizer has an axially extending cylindrical rotor disposed generally coaxially within a cylindrical stator with a gap of at least 1.5 mm being defined therebetween for the pulverization of the toner composition.

14. A process as claimed in claim 13, wherein said rotor is operated at a peripheral speed of less than 100 m/s.

15. A process as claimed in claim 10, wherein said second pulverizer has an axially extending cylindrical rotor disposed generally coaxially within a cylindrical stator with a gap of less than 1.5 mm being defined therebetween for the pulverization of the toner composition.

16. A process as claimed in claim 15, wherein said rotor is operated at a peripheral speed of at least 100 m/s.

17. A process as claimed in claim 10, wherein the preliminarily pulverized particles are fed to said second step at a feed rate of W kg/h while feeding a gas to said second step at a flow rate of M $m^3$/minute, and wherein the ratio W/M is in the range of 1–200.

18. A process as claimed in claim 10, wherein the preliminarily pulverized particles have an average roundness of 0.85–0.95 and wherein the finely pulverized particles have an average roundness greater than that of the preliminarily pulverized particles and in the range of 0.90–0.98.

* * * * *